US010316447B2

(12) United States Patent
Chae et al.

(10) Patent No.: US 10,316,447 B2
(45) **Date of Patent: *Jun. 11, 2019**

(54) LAUNDRY TREATING APPARATUS AND CONTROL METHOD FOR THE SAME

(71) Applicant: LG ELECTRONICS INC., Seoul (KR)

(72) Inventors: Kyosoon Chae, Seoul (KR); Dongsoo Lee, Seoul (KR); Sangwook Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 14 days.

This patent is subject to a terminal disclaimer.

(21) Appl. No.: 15/639,649

(22) Filed: Jun. 30, 2017

(65) Prior Publication Data

US 2018/0171534 A1 Jun. 21, 2018

Related U.S. Application Data

(63) Continuation of application No. 15/628,920, filed on Jun. 21, 2017, now Pat. No. 10,036,109.

(30) Foreign Application Priority Data

Dec. 16, 2016 (KR) ..... 10-2016-0173013

(51) Int. Cl.
*B08B 9/093* (2006.01)
*D06F 23/04* (2006.01)
(Continued)

(52) U.S. Cl.
CPC ..... *D06F 23/04* (2013.01); *A47L 15/4214* (2013.01); *A47L 15/44* (2013.01);
(Continued)

(58) Field of Classification Search
CPC ..... D06F 29/00
See application file for complete search history.

(56) References Cited

U.S. PATENT DOCUMENTS

2009/0139275 A1 6/2009 Kim et al.
2010/0269266 A1 10/2010 Lee et al.
(Continued)

FOREIGN PATENT DOCUMENTS

EP 3112516 A1 1/2017
EP 3112522 A1 1/2017
(Continued)

OTHER PUBLICATIONS

United States Office Action issued in U.S. Appl. No. 15/628,920, dated Aug. 4, 2017, 8 pages.
(Continued)

*Primary Examiner* — Jason Y Ko
(74) *Attorney, Agent, or Firm* — Fish & Richardson P.C.

(57) ABSTRACT

A laundry treating apparatus includes a cabinet with first and second cabinet doors. A first washing apparatus processes laundry that is placed through the first cabinet door at the front. A second washing apparatus processes laundry that is placed through the second cabinet door at the top. The second washing apparatus includes: a tub that holds water and has an opening at a top that is accessible through the second opening of the cabinet; a tub cover that covers the top of the tub and defines an inlet through which the tub is accessible; a tub door on the tub cover that opens or closes the inlet of the tub cover separately from the second cabinet door opening or closing the second opening; a drum inside the tub configured to rotate about a vertical shaft; and a first sensor that generates a signal based on the tub door being open.

18 Claims, 5 Drawing Sheets

(51) Int. Cl.

| | |
|---|---|
| ***D06F 29/00*** | (2006.01) |
| ***D06F 37/28*** | (2006.01) |
| ***D06F 39/14*** | (2006.01) |
| ***D06F 58/02*** | (2006.01) |
| ***A47L 15/42*** | (2006.01) |
| ***A47L 15/44*** | (2006.01) |
| ***D06F 39/02*** | (2006.01) |
| ***D06F 39/08*** | (2006.01) |
| *D06F 21/06* | (2006.01) |
| *D06F 58/00* | (2006.01) |
| *A47L 15/00* | (2006.01) |
| *D06F 39/00* | (2006.01) |

(52) U.S. Cl.

CPC ..... *D06F 29/00* (2013.01); *D06F 37/28* (2013.01); *D06F 39/022* (2013.01); *D06F 39/028* (2013.01); *D06F 39/08* (2013.01); *D06F 39/14* (2013.01); *D06F 58/02* (2013.01); *A47L 15/00* (2013.01); *D06F 21/06* (2013.01); *D06F 39/00* (2013.01); *D06F 58/00* (2013.01)

(56) References Cited

U.S. PATENT DOCUMENTS

2016/0032516 A1* 2/2016 Lee ..... D06F 39/007 68/13 A
2016/0160422 A1* 6/2016 Lee ..... D06F 39/14 312/326

FOREIGN PATENT DOCUMENTS

WO WO2008069607 A1 6/2008
WO WO2016173565 A1 11/2016

OTHER PUBLICATIONS

Extended European Search Report in European Application No. 17181880.0, dated Feb. 12, 2018, 10 pages.
Extended European Search Report in European Application No. 17208823.9, dated Mar. 22, 2018, 11 pages.

* cited by examiner

LAUNDRY TREATING APPARATUS AND CONTROL METHOD FOR THE SAME

CROSS-REFERENCE TO RELATED APPLICATIONS

This application is a continuation of U.S. application Ser. No. 15/628,920, filed on Jun. 21, 2017, which claims the benefit of an earlier filing date and right of priority to Korean Patent Application No. 10-2016-0173013, filed on Dec. 16, 2016. The disclosures of the prior applications are incorporated by reference in their entirety.

TECHNICAL FIELD

The present disclosure generally relates to a laundry treating apparatus and a control method for the same.

BACKGROUND

Generally, laundry treating apparatuses include an apparatus for washing laundry, an apparatus for drying laundry, or an apparatus for performing both washing and drying of laundry. As such, a laundry treating apparatus may perform a washing or drying function only, or may perform both washing and drying functions. Also, some washing machines are provided with a steam supply device that has a refresh function, such as wrinkle removal, smell removal, or electrostatic removal.

Laundry treating apparatuses are typically categorized into front loading types and top loading types in accordance with a direction in which laundry is loaded. Laundry treating apparatuses are also often categorized as vertical types or horizontal types in accordance with a washing process, wherein a pulsator or washing tub is rotated in vertical type machines, and a drum is rotated in horizontal type machines.

A common example of a horizontal type laundry treating apparatuses is a drum washing machine or a drum dryer.

A front loading type laundry treating apparatus includes a laundry treating apparatus provided with an opening at the front, having a drum of which a rotational shaft is either parallel with the ground or has a certain slope. In addition, a top loading type laundry treating apparatus is a laundry treating apparatus provided with an opening at the top, having a drum of which a rotational shaft is vertical to the ground.

SUMMARY

Implementation described herein provide a laundry treating apparatus and a control method for the same.

In one aspect, a laundry treating apparatus may include a cabinet provided with a first opening and a second opening; and a first cabinet door and a second cabinet door provided in the cabinet and configured to respectively open or close the first opening and the second opening. The laundry treating apparatus may also include a first washing apparatus provided inside the cabinet and configured to process laundry that is placed through the first cabinet door at a front of the first washing apparatus; and a second washing apparatus configured to process laundry that is placed through the second cabinet door at a top of the second washing apparatus. The second washing apparatus may include: a tub configured to hold water and having an opening at a top of the tub that is accessible through the second opening of the cabinet; a tub cover arranged on the tub and provided to cover the top of the tub, the tub cover defining an inlet through which an inside of the tub is accessible; a tub door provided at the tub cover and configured to open or close the inlet of the tub cover separately from the second cabinet door opening or closing the second opening; a drum provided inside the tub and configured to rotate about a vertical rotational shaft; and a first sensor module configured to generate a signal based at least in part on sensing an open state of the tub door.

In some implementations, the laundry treating apparatus may further include at least one processor configured to control the second washing apparatus by operating the second washing apparatus in a driving mode based at least in part on the first sensor module sensing that the tub door of the tub in the second washing apparatus is in a closed state.

In some implementations, the laundry treating apparatus may further include a notification unit configured to output a notification that the second washing apparatus cannot be operated in the driving mode based at least in part on the first sensor module sensing that the tub door of the tub in the second washing apparatus is in the open state.

In some implementations, the laundry treating apparatus may further include at least one processor configured to control the second washing apparatus by, in a state of the second washing apparatus is operated in the driving mode, stopping the driving mode of the second washing apparatus based at least in part on the first sensor module sensing that the tub door of the tub in the second washing apparatus is in the open state.

In some implementations, the at least one processor may be configured to, in a state in which the second washing apparatus has been stopped from operating in the driving mode, start the driving mode of the second washing apparatus based on the first sensor module sensing that the tub door of the tub in the second washing apparatus is in a closed state.

In some implementations, the laundry treating apparatus may further include: at least one first processor configured to control the first washing apparatus; and at least one second processor configured to control the second washing apparatus. The at least one first processor and the at least one second processor may be configured to respectively control the first washing apparatus and the second washing apparatus independently from each other.

In some implementations, the laundry treating apparatus may further include: at least one first processor configured to control the first washing apparatus; and at least one second processor configured to control the second washing apparatus. The at least one second processor may be configured to control, through the at least one first processor, the first washing apparatus to stop a driving mode of the first washing apparatus.

In some implementations, the laundry treating apparatus may further include a second sensor module configured to sense whether the second cabinet door is in an open state or in a closed state, wherein the first sensor module is activated to operate in a sensing mode based at least in part on the second sensor module sensing that the second cabinet door is in the closed state.

In some implementations, the laundry treating apparatus may further include at least one second processor configured to control the second washing apparatus by: based at least in part on a determination, through the second sensor module, that the second cabinet door is in an open state during operation of a driving mode of the second washing apparatus, stopping the driving mode of the second washing apparatus and disabling a sensing operation of the second sensor module.

In some implementations, the second washing apparatus may be arranged above the first washing apparatus, and the second cabinet door may form a top surface of the laundry treating apparatus.

In some implementations, in a state in which the second cabinet door and the tub door of the tub in the second washing apparatus are closed, the second cabinet door may be arranged to be spaced apart from a top surface of the tub door.

In some implementations, the tub door may include a first hinge and the second cabinet door may include a second hinge.

In some implementations, the tub door and the second cabinet door may be configured to be opened and closed by rotation about the first hinge and the second hinge, respectively. The first hinge that rotates the tub door may include a first shaft, the second hinge that rotates the second cabinet door may include a second shaft, and the first shaft and the second shaft may be arranged in parallel with each other.

In some implementations, the first sensor module may be configured to sense a change in distance between the second cabinet door and the tub door of the tub in the second washing apparatus.

In some implementations, the first sensor module may include: a magnetic force generator provided in one of the second cabinet door or the tub door of the tub in the second washing apparatus; and a magnetic force sensor provided in the other one of the second cabinet door or the tub door, the magnetic force sensor configured to sense a change of a magnetic force of the magnetic force generator.

In some implementations, the first sensor module may include a push switch provided in one of the second cabinet door or the tub door.

In some implementations, the first sensor module may include: an illuminator provided in one of the second cabinet door or the tub door and configured to illuminate light; and a light-receiving module provided in one of the second cabinet door or the tub door and configured to sense the illuminated light.

In some implementations, the first sensor module may be configured to generate the signal based at least in part on sensing the open state of the tub door by: generating the signal based on sensing the open state of the tub door and further based on the second cabinet door being in a closed state.

In some implementations, the laundry treating apparatus may further include a second sensor module configured to sense whether the second cabinet door is in an open state or in the closed state.

In some implementations, the at least one processor may be configured to operate the second washing apparatus in the driving mode based at least in part on the first sensor module sensing that the tub door is in the closed state by: operating the second washing apparatus in the driving mode based on the first sensor module sensing that the tub door is in the closed state, and further based on the second cabinet door being in a closed state.

It is to be understood that both the foregoing general description and the following detailed description provide examples of some implementations, and are not intended to be limiting.

DETAILED DESCRIPTION

Figure 1:
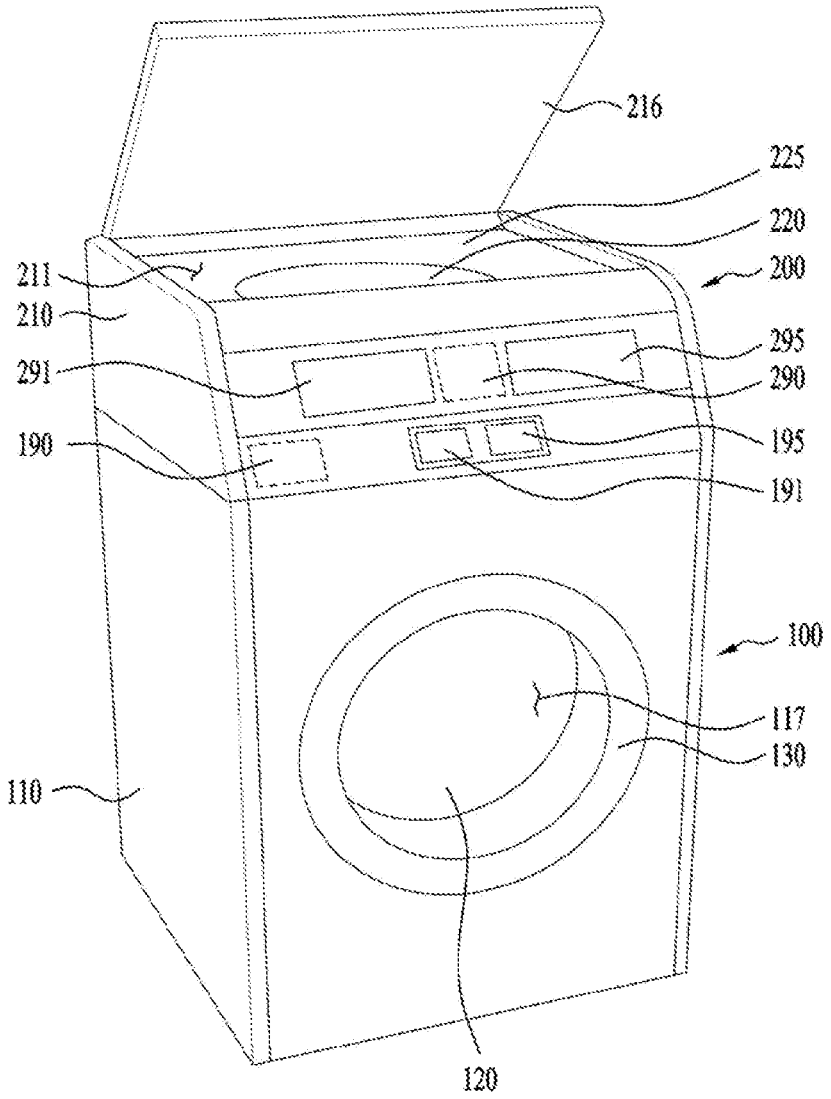
FIG. 1 is a diagram that illustrates an example of an external appearance of a laundry treating apparatus according to some implementations.

Implementations are described herein that provide a laundry treating apparatus that senses whether a door provided on a tub mounted inside a cabinet is in an opened state. In some implementations, the laundry treatment apparatus may sense whether the tub door is opened in a state in which an external cabinet door is in a closed state. The cabinet door may be a door of a cabinet in which the tub is mounted, and may be implemented in a top loading type laundry treating apparatus. According to such implementations, in some scenarios, the laundry treating apparatus may mitigate scenarios in which a user unwittingly operates the laundry treating apparatus in a state in which the inner tub door is in an open state.

A recent trend of laundry treating apparatuses has gradually been toward larger sizes in response to user demand. That is, a size of an external appearance of washing machines for home use has gradually become enlarged.

In some scenarios, one large-scaled laundry treating apparatus is used in a home. In such scenarios, the laundry treating apparatus is used several times if a user desires to wash different types of laundry. For example, if the user desires to wash laundry such as adult clothes independently from laundry such as underwear or baby clothes, the user typically uses the laundry treating apparatus multiple times to wash the latter laundry after washing of the former laundry is completed. In such scenarios, increased washing time is required, and energy consumption is increased.

Also, in washing small amount of laundry, it may not be preferable to use a large-scaled laundry treating apparatus, in view of energy consumption and water consumption. Also, since a large-scaled drum or inner-tub is often rotated in such large-scale machines, power consumption is increased. Further, since the washing course is scheduled for large amount of laundry, washing time is relatively long.

Also, if a large-scaled laundry treating apparatus is provided with a washing course scheduled for general clothes, it may not be suitable for washing of sensitive clothes such as underwear or baby clothes.

Large-scaled laundry treating apparatuses also may not be suitable for scenarios in which small amounts of laundry are washed frequently, which may be desirable for some users.

However, even in scenarios of small-scaled laundry treating apparatuses, it is often not preferable to arrange two laundry treating apparatuses laterally to each other, in view of space utility and external appearance.

Implementations disclosed herein provide a laundry treating apparatus provided with a top loading type laundry treating apparatus that is arranged above a front loading type laundry treating apparatus.

The top loading type laundry treating apparatus is provided above the front loading type laundry treating apparatus and is configured to wash small amounts of laundry, and is able to achieve efficiency and improved space utility.

The top loading type laundry treating apparatus may be an auxiliary laundry treating apparatus, and may have a limited height. Although larger sizes of top loading type laundry treating apparatus may be advantageous in providing an increased washing area, if the top loading type laundry treating apparatus is provided above another laundry treating apparatus, then an increased size of the top-loading apparatus may cause difficulty for a user to approach or use the top loading type laundry treating apparatus. Therefore, the top loading type laundry treating apparatus according to some implementations may be configured with a height that is relatively lower than that of the top loading type laundry treating apparatus of the related art.

However, if the top loading type laundry treating apparatus is provided at a lower height and smaller size, then this may have a disadvantage that water may overflow from a tub inside the top loading apparatus. As such, the tub of the top loading type laundry treating apparatus may be provided with a door for opening or closing an opening of the tub.

In some implementations, even in the case that the tub is provided with a door, a separate door may be provided on the cabinet of the top loading type apparatus to form an external appearance of the top loading type laundry treating apparatus, so that inner components are not externally exposed, and whereby esthetic sense is improved and safety is improved by preventing objects from entering inside the cabinet that may cause accidents.

However, even in the case that the door provided in the cabinet is closed, a user may not recognize that the door provided in the tub is opened.

When the top loading type laundry treating apparatus washes laundry using water and detergent or is operated to dehydrate water contained in the laundry, a problem may occur in that water and detergent in the tub may overflow if the door provided in the tub is opened. However, if the door of the cabinet is closed, then a user may fail to recognize that water or detergent in the tub overflows.

Also, if the door of the tub is opened while the top loading type laundry treating apparatus is being operated, this may increase risk of corrosion, electric shock, and short circuits.

Implementations are described herein that provide a laundry treating apparatus that senses whether a door provided in a tub is opened. In some implementations, the laundry treatment apparatus may sense whether the tub door is opened in a state in which a door provided in a cabinet of a top loading type laundry treating apparatus is closed. In such implementations, the laundry treatment apparatus may mitigate scenarios in which the outer cabinet door is closed, but the inner tub door is still open.

In some scenarios, the laundry treating apparatus may allow a user to take precaution if it is sensed that a door provided in a tub is opened when a door provided in a cabinet of a top loading type laundry treating apparatus is closed. The laundry treating apparatus may also allow a user to take precaution if it is sensed that a door provided in a tub is opened while a top loading type laundry treating apparatus is being operated.

A laundry treating apparatus according to some implementations includes a cabinet provided with an opening; a cabinet door provided in the cabinet to open or close the opening; a tub provided to approach the opening opened by the cabinet door, storing water and having an opened top; a tub cover arranged on the tub and provided to cover the top of the tub, having an inlet into which laundry is put; a tub door provided at the tub cover to open or close the inlet and provided to be manipulated by a user separately from the cabinet door; a drum provided rotatably based on a vertical rotational shaft inside the tub; and a sensor module generating a signal by sensing whether the tub door has opened the inlet (e.g., in a state that the cabinet door is closed).

The laundry treating apparatus further includes at least one processor, such as a controller, controlling a driving mode of the laundry treating apparatus, wherein the controller may control the laundry treating apparatus to be driven if it is determined through the sensor module that the tub door is closed before the driving of the laundry treating apparatus.

The laundry treating apparatus may further include a notification portion notifying a user that the laundry treating apparatus cannot be driven if it is determined through the sensor module that the tub door is opened. The notification portion may be a visual and/or auditory notification means.

The laundry treating apparatus further includes a controller controlling driving of the laundry treating apparatus, wherein the controller may stop driving of the laundry treating apparatus if it is determined through the sensor module that the tub door is opened in the course of driving of the laundry treating apparatus.

The controller may perform a control command to allow the laundry treating apparatus to process laundry if it is determined through the sensor module that the tub door is closed during stop of driving of the laundry treating apparatus.

The laundry treating apparatus may further include a second sensor module determining whether the cabinet door has opened or closed the opening, wherein the sensor module may be enabled after the second sensor module senses that the opening is closed. That is, in some implementations, a control operation may be performed using the sensed result of the sensor module only if it is sensed through the sensor module that the opening is closed.

The laundry treating apparatus may further include a controller controlling a driving mode of the laundry treating apparatus, wherein the controller may stop driving of the laundry treating apparatus and disable the sensor module if it is determined through the second sensor module that the cabinet door is opened in the course of driving of the laundry treating apparatus. That is, the sensed result of the sensor module may not be used. This is because that opening or closing of the tub door is not meaningless if the cabinet door is opened.

The cabinet door may be arranged to be spaced apart from the top of the tub door in a state that the cabinet door and the tub door are closed.

In some implementations, each of the cabinet door and the tub door has a door hinge.

The cabinet door and the tub door are provided to be opened or closed by rotation, and hinge shafts of the door hinges may be arranged in parallel with each other.

In some implementations, the sensor module is provided to sense an interval change between the cabinet door and the tub door, for example by sensing a change in distance between the cabinet door and the tub door.

As an example, the sensor module may include a magnetic force generator provided in any one of the cabinet door and the tub door, and a Reed sensor provided in the other one of the cabinet door and the tub door to sense a change of a magnetic force of the magnetic force generator. As such the sensor module may sense a change in distance between the cabinet door and the tub door by sensing changes in the magnetic force of the magnetic force generator.

The sensor module may include a push switch provided in any one of the cabinet door and the tub door.

The sensor module may include an illuminator provided in any one of the cabinet door and the tub door to illuminate light, and a light-receiving module provided in any one of the cabinet door and the tub door to sense the illuminated light.

In some implementations, the tub door includes a sealing module for sealing the inside and the outside of the tub through the inlet.

A laundry treating apparatus according to some implementations includes a cabinet provided with an opening; a cabinet door provided in the cabinet to open or close the opening; a tub provided to approach the opening opened by the cabinet door, storing water and having an opened top; a tub cover arranged on the tub and provided to cover the top of the tub, having an inlet into which laundry is put; a tub door provided at the tub cover to open or close the inlet and provided to be manipulated by a user separately from the cabinet door; a drum provided rotatably based on a vertical rotational shaft inside the tub; and a sensor module generating a signal by sensing whether the tub door has opened the inlet in a state that the cabinet door is closed.

In some implementations, a laundry treating apparatus according to some implementations includes a first cabinet provided with a first opening at the front; a laundry container provided inside the first cabinet to receive laundry therein; a second cabinet provided with a second opening at the top and detachably provided on the first cabinet; a second tub provided inside the second cabinet, having an inlet communicating with the second opening and receiving laundry therein; a tub door opening or closing the inlet; and a sensor module generating a signal by sensing whether the tub door has opened the inlet.

In some implementations, a laundry treating apparatus according to some implementations includes a first cabinet provided with a first opening at the front; a laundry container provided inside the first cabinet to receive laundry therein; a second cabinet detachably coupled to the top of the first cabinet; a second tub provided inside the second cabinet, having an inlet communicating with the second opening and receiving laundry therein; a tub door opening or closing the inlet; a second cabinet door opening or closing the second opening; a sensor module generating a signal by sensing whether the tub door has opened the inlet in a state that the second cabinet door has closed the second opening; and a controller determining whether the tub door has opened the inlet in a state that the second cabinet door has closed the second opening by receiving the signal generated by the sensor module.

The sensor module includes a switch provided in any one of the second cabinet door and the tub door to generate a signal if an external force is applied thereto.

The sensor module includes a magnetic force generator provided in any one of the second cabinet door and the tub door to generate a magnetic force, and a Reed sensor provided in the other one of the second cabinet door and the tub door to generate a signal by sensing the magnetic force of the magnetic force generator.

The sensor module includes an optical sensor provided in any one of the second cabinet door and the tub door to generate a signal by sensing illuminance.

The optical sensor includes an illuminator illuminating light to any one of the second cabinet door and the tub door, and a light-receiving portion sensing reflected intensity of light illuminated to the other one of the second cabinet door and the tub door.

The laundry treating apparatus further includes a second sensor module determining whether the second cabinet door has closed the second opening, wherein the controller senses that the tub door has opened the inlet if the signal is sensed through the second sensor module in a state that the second cabinet door has closed the second opening.

In some implementations, in a control method of a laundry treating apparatus according to some implementations including a cabinet provided with an opening, a tub provided in the cabinet, having an inlet communicating with the opening and providing a space for storing water; a drum rotatably provided in the tub to receive laundry therein; a driving module rotating the drum; a tub door opening or closing the inlet; a second cabinet door opening or closing the opening; and a sensor module sensing whether the tub door has opened the inlet in a state that the second cabinet door has closed the opening, the control method includes an input step of receiving a control command for operating the laundry treating apparatus; a sensing step of sensing whether the tub door has closed the inlet by controlling the sensor module; and a step of performing the control command.

The control command may include at least one of rotation of the drum, and hot-air supply to the tub and steam supply to the tub.

The control command may further include water supply or drainage of the tub.

If it is sensed at the sensing step that the tub door has opened the inlet, it is on standby until the tub door closes the inlet.

The laundry treating apparatus further includes a display module for displaying or notifying a state of the laundry treating apparatus, and the control method further includes a first notification step of displaying, for a user, that the tub door has opened the inlet by controlling the display module if it is sensed through the sensor module at the sensing step that the tub door has opened the inlet.

The control method further includes a door opening sensing step of sensing whether the tub door has opened the inlet through the sensor module in the course of performing the control command.

The laundry treating apparatus further includes a display module for displaying or notifying a state of the laundry treating apparatus, and the control method further includes a second notification step of displaying, for a user, that the tub door has opened the inlet by controlling the display module if it is sensed through the sensor module at the door opening sensing step that the tub door has opened the inlet.

The control method further includes a safety-accident precaution step of preventing a safety-accident if it is sensed that the tub door has opened the inlet, at the door opening sensing step by controlling the sensor module.

The safety-accident precaution step includes at least one of the state that rotation of the drum is stopped, the state that hot-air supply to the tub is stopped, the state that steam supply to the tub is stopped, and the state that water supply or drainage of the tub is stopped.

The control method further includes a door closing sensing step of sensing whether the tub door has again closed inlet by controlling the sensor module.

If it is sensed at the door closing sensing step that the tub door has closed the inlet, the step of performing the control command is performed again.

If the state that the tub door opens the inlet is maintained at the door closing sensing step, the second notification step is repeated.

According to the present disclosure, there is provided a laundry treating apparatus that senses that a door provided in a tub is opened when a door provided in a cabinet of a top loading type laundry treating apparatus is closed.

According to the present disclosure, there is provided a laundry treating apparatus that allows a user to take precaution for safety-accident if it is sensed that a door provided in a tub is opened when a door provided in a cabinet of a top loading type laundry treating apparatus is closed.

According to the present disclosure, there is provided a laundry treating apparatus that allows a user to take precaution for safety-accident if it is sensed that a door provided in a tub is opened while a top loading type laundry treating apparatus is being operated.

Reference will now be made in detail to examples of some implementations, which are illustrated in the accompanying drawings. Elements or control methods of an apparatus, which will be described below, are only intended to describe some examples of implementations and are not intended to restrict the scope of the present disclosure. Wherever possible, the same reference numbers will be used throughout the drawings to refer to the same or like parts.

Figure 2:
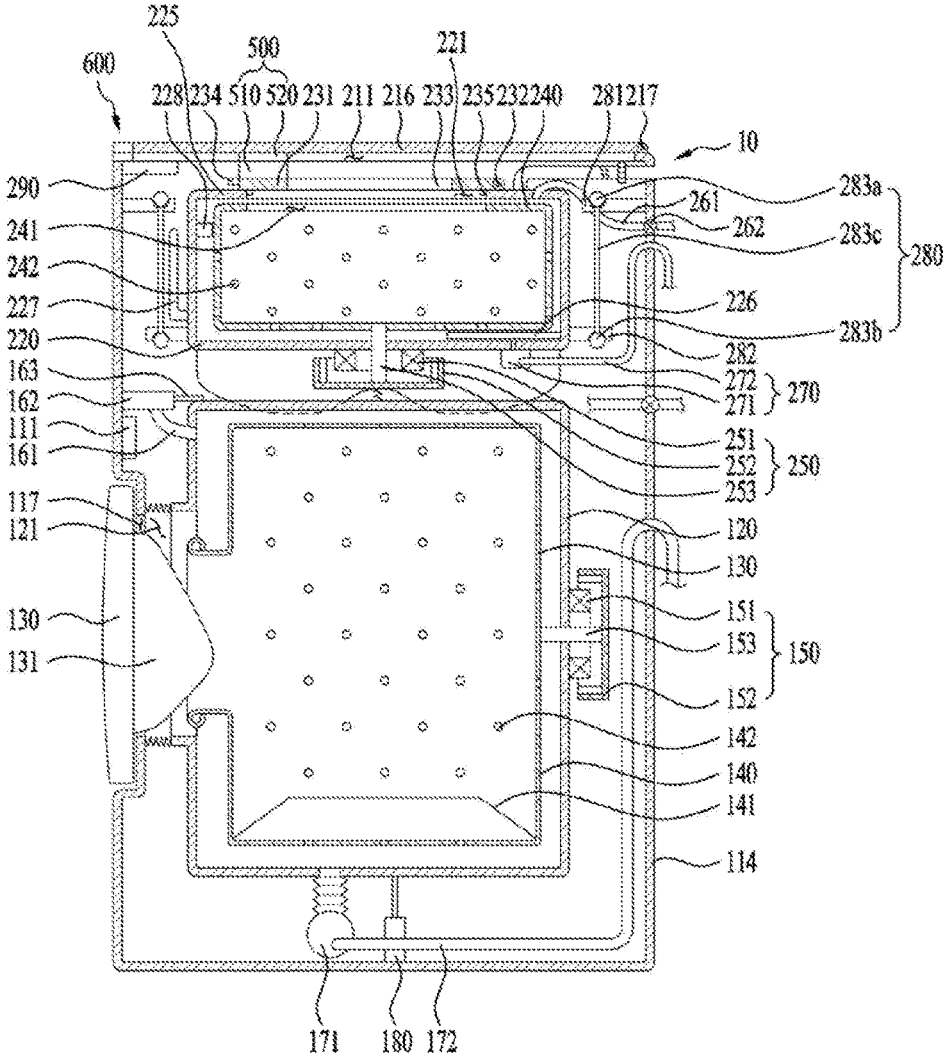
FIG. 2 is a diagram of a cross-sectional view illustrating an example of a laundry treating apparatus according to some implementations.

As shown in FIGS. 1 and 2, a laundry treating apparatus according to some implementations includes a lower front loading type laundry treating apparatus 100 and a top loading type laundry treating apparatus 200 provided on the front loading type laundry treating apparatus 100. The former apparatus may be referred to as a first washing apparatus, and the latter apparatus may be referred to as a second washing apparatus.

In some implementations, the top loading type laundry treating apparatus 200 may be provided in a single body with the front loading type laundry treating apparatus 100.

As described above, the front loading type laundry treating apparatus means a laundry treating apparatus provided with an opening at the front, having a drum of which rotational shaft is parallel with the ground or has a certain slope, and the top loading type laundry treating apparatus means a laundry treating apparatus provided with an opening at the top, having a drum of which rotational shaft is vertical to the ground.

The front loading type laundry treating apparatus 100 will be defined as a first washing apparatus, and the top loading type laundry treating apparatus will be defined as a second washing apparatus.

The laundry treating apparatus according to some implementations may be provided in such a manner that the first washing apparatus 100 and the second washing apparatus 200 are combined with each other, or may be provided in such a manner that the first washing apparatus 100 and the second washing apparatus 200 are formed in a single body.

The laundry treating apparatus according to some implementations may include a first cabinet 110 provided with a first opening 117 at the front, first laundry containers 120 and 140 provided inside the first cabinet 110 to receive laundry, a second cabinet 210 provided with a second opening 211 at the top and provided on the first cabinet 110, and second laundry containers 220 and 240 provided inside the second cabinet 210 to receive laundry.

The first cabinet 110 may form external appearance of the first washing apparatus 100, and the second cabinet 210 may form external appearance of the second washing apparatus 200.

The laundry treating apparatus may be implemented through one cabinet, and the upper cabinet may be referred to as the first cabinet, and the lower cabinet may be referred to as the second cabinet.

Also, the first cabinet 110 and the second cabinet 210 may be coupled to each other to form external appearance of the laundry treating apparatus according to some implementations.

Also, the first cabinet 110 and the second cabinet 210 may be provided in a single body to form external appearance of the laundry treating apparatus according to some implementations.

At the front of the first cabinet 110, a first display module 195 for displaying a state of the first washing apparatus 100, a first input module 191 for receiving an operation command of the first washing apparatus 100, and at least one processor, such as a first controller 190, for controlling an operation of the first washing apparatus 100 may be provided.

Also, on the top of the first cabinet 110, a second display module 295 for displaying a state of the second washing apparatus 200, a second input module 291 for receiving an operation command of the second washing apparatus 200, and at least one processor, such as a second controller 290, for controlling an operation of the second washing apparatus 200 may be provided.

If the second washing apparatus 200 is coupled to the top of the first washing apparatus 100 or the first washing apparatus 100 and the second washing apparatus 200 are provided in a single body, any one of the first controller 190 and the second controller 290 may control both the first washing apparatus and the second washing apparatus.

Also, an operation command may be input to both the first washing apparatus and the second washing apparatus by the first input module 191 or the second input module 292.

Each of the first display module 195 and the second display module 295 may include a panel such as LCD and LED, and may include a speaker for transferring information to a user by generating a sound. That is, the first display module 195 and the second display module 295 may display information of the laundry treating apparatus to the user, or may ring an alarm when there is notification.

In some implementations, the first washing apparatus 100 may be provided as a washing apparatus for washing laundry with detergent and water, or may be provided as a drying apparatus for drying laundry with hot air, etc.

If the first washing apparatus 100 is provided as a washing apparatus, the first laundry containers 120 and 140 may include a first tub 120 having a first inlet 121 communicating with the first opening 117, for providing a space for storing water, and a first drum 140 rotatably provided in the first tub 120, receiving laundry therein.

If the first washing apparatus 100 is provided as a drying apparatus, the first laundry containers 120 and 140 may include a first drum 140 rotatably received in the first cabinet 110 to receive laundry therein.

FIGS. 1 and 2 illustrate that the first washing apparatus 100 is provided as a washing apparatus, but does not exclude that the first washing apparatus 100 is provided as a drying apparatus.

Also, the second washing apparatus 200 may be provided as a washing apparatus for washing laundry with detergent and water, or may be provided as a drying apparatus for drying laundry with hot air, etc.

If the second washing apparatus 200 is provided as a washing apparatus, the second laundry containers 220 and 240 may include a second tub 220 having a second inlet 221 communicating with the second opening 211, for providing a space for storing water, and a second drum 240 rotatably provided in the second tub 220, receiving laundry therein.

A water level sensor 227 for sensing a water level of the second tub 220 may be provided at one side of the second tub 220, and a temperature sensor 228 for sensing a temperature of the second tub 220 may be provided on an inner circumference of the second tub 220.

If the second washing apparatus 200 is provided as a drying apparatus, the second laundry containers 220 and 240 may include a second drum 240 rotatably received in the second cabinet 210 to receive laundry therein.

FIGS. 1 and 2 illustrate that the second washing apparatus 200 is provided as a washing apparatus, but does not exclude that the second washing apparatus 200 is provided as a drying apparatus.

The first washing apparatus 100 includes a first cabinet door 130 for opening or closing the first opening 117, wherein the first cabinet door 130 may include a door gasket 131 for sealing the first inlet 121 of the first tub 120 at the first opening 117 when the first opening 117 is closed.

In some implementations, the first washing apparatus 100 may include a first water supply module for supplying water to the first tub 120, and a first drainage module for draining the water of the first tub 120.

The first water supply module may include a first water supply pipe 161 for supplying water from an external water supply source, a detergent box for diluting the water supplied to the first water supply pipe 161 with a detergent stored therein and supplying the diluted water to the first tub 120, and a first supply pipe 163 for moving the water and the detergent by communicating with the first tub 120 at the detergent box.

The first drainage module may include a first drainage pipe 172 provided below the first tub 120, draining the water, and a drainage pump 171 for draining the water of the first drainage pipe 172 to the outside of the first cabinet 110.

In some implementations, the first washing apparatus 100 may include a support attenuator 180 supporting the first tub 120 in the first cabinet 110 and attenuating vibration generated in the first tub 120 so as not to be transferred to the first cabinet 110.

The support attenuator 180 may be provided as a damper, a spring, or combination of the damper and the spring. Alternatively, a plurality of support attenuators 180 may be provided. The support attenuator 180 may be provided on or below the first tub 120, or may be provided on and below the first tub 120.

In some implementations, the first washing apparatus 100 may include a first driving module 150 for rotating the first drum 140.

The first driving module 150 may include a first stator 151 provided on a rear surface of the first tub 120, generating a rotational magnetic field, a first rotor 152 rotated by the rotational magnetic field of the first stator 151, and a rotational shaft 153 having one end connected to the first rotor 152 and the other end connected to the first drum 140 by passing through the first tub 120.

The rotational shaft 153 may be provided in parallel with the ground, or may be provided to be inclined upwardly on the ground.

The first drum 140 may include a lifter 141 for improving washing performance by lifting and dropping laundry when the first drum 140 is rotated, and may include a plurality of hollow holes into or out which the water of the first tub 120 flows.

In some implementations, since the second washing apparatus 200 is provided on the first washing apparatus 100, its height could be limited. That is, if the second washing apparatus 200 is provided at a high height, its washing area is increased but it is difficult to allow a user to approach the second opening 211.

Therefore, the second tub 220 may be provided at a relatively low height, and it is likely that the water or laundry contained in the second tub 220 may overflow toward the outside of the second tub 220.

The second tub 220 may include a tub door 230 for opening or closing the second inlet 221. The tub door 230 may allow the water or laundry contained in the second tub 220 not to overflow toward the outside of the second tub 220 by closing the second inlet 221.

In more detail, the top of the tub may be provided to store water, and may be formed to be opened. A tub cover 225 may be provided to be arranged on the tub to cover the top of the tub, and includes an inlet hole into which the laundry is put. The tub cover 225 may be provided to cover an interval between the tub and the drum. Therefore, the tub door 230 may be provided with the second inlet 221, and may open or close the second inlet. The tub door 230 may be fixed to the tub cover 225. As described later, an opening or closing direction of the second cabinet door may be the same as that of the tub door. That is, the second cabinet door and the tub door may be opened by rotation, and their rotational shafts may be provided in parallel with each other.

The tub door 230 may be provided rotatably on the second tub 220.

The tub door 230 may include a frame 231 rotatably coupled through a door hinge 400, a window 233 provided in the frame 231, and a door handle 234 for detachably coupling the frame 231 to the second tub 220.

The window 233 may be made of a transparent material to allow the user to see the inside of the second tub 220.

In some implementations, the tub door 230 may further include a sealing module 235 provided on an inner circumference of the frame 231 or the second inlet 221, for sealing a space between the frame 231 and the second inlet 221 when the tub door 230 closes the second inlet 221, thereby preventing the water of the second tub 220 from draining toward the outside of the second tub 220 through the second inlet 221.

The second washing apparatus 200 may include a second water supply module for supplying the water to the second tub 220 and a second drainage module 270 for draining the water of the second tub 220.

The second water supply module may include a second water supply pipe 261 for supplying water from the external water supply source to the second tub 220, and a water supply valve 262 for controlling a flow rate of the second water supply pipe 261.

The second drainage module 270 may include a second drainage pipe 272 provided below the second tub 220, draining the water of the second tub 220, and a drainage pump 271 for draining the water of the second drainage pipe 272 to the outside of the second cabinet 210 by communicating with the second drainage pipe 272.

In some implementations, the second water supply module and the second drainage module 270 may be provided separately from the first water supply module and the first drainage module.

The second water supply module and the second drainage module 270 may be provided in a single body with the first water supply module and the first drainage module, or may be provided to be forked from the first water supply module and the first drainage module.

This is because that the second washing apparatus 200 and the first washing apparatus 100 may be provided independently although the second washing apparatus 200 may detachably be provided in the first washing apparatus.

The second cabinet door 216 may form the top of the second cabinet 210, or may be provided rotatably at one side of the second cabinet 210. The second cabinet door 216 may rotatably be coupled to the second cabinet 210 through a cover hinge 217. The cover hinge 217 may be provided at one side of the second cabinet door 216.

The second drum 240 may include a drum inlet 241 communicating with the second inlet 21, and may also include a plurality of hollow holes into or out which the water of the second tub 220 flows.

In some implementations, the second washing apparatus 200 may include a second driving module 250 for rotating the second drum 240 in the second tub 220.

The second driving module 250 may include a second stator 251 fixed to a lower surface of the second tub 220, generating a rotational magnetic field, a second rotor 252 rotated by the rotational magnetic field of the second stator 251, and a rotational shaft 253 having one end connected to the second rotor 252 and the other end connected to the second drum 240 by passing through the second tub 220.

In some implementations, the second washing apparatus 200 may include a heater 226 for heating the water contained in the second tub 220.

Also, the second washing apparatus 200 may further include a hot-air supply module 10 that may dry laundry contained in the second tub 220 or the second drum 240. In some implementations, steam may be supplied to the second tub 220 through the hot-air supply module 10, or steam may be generated by heating the heater 226.

Also, the second washing apparatus 200 may include a temperature sensor 228 for measuring a temperature of the second tub 220, and a water level sensor 227.

In some implementations, the second washing apparatus 200 may include a second cabinet door 216 provided to open or close the second opening 211.

This is because that esthetic effect is degraded and safety-accident may occur if the second water supply module, the second drainage module 270 and the second driving module 250, which are provided in the second cabinet 210 and the second tub 220, are externally exposed.

In some implementations, the second washing apparatus 200 may include a support module 280 for supporting the second tub 220 in the second cabinet 210.

The support module 280 may include a first support 281 provided in the second cabinet 210, a second support 282 provided in the second tub, and a connector 283 for connecting the first support 281 with the second support 282.

The first support 281 may be provided above the second support 282, and the connector 283 has one end coupled to the first support 281 and the other end supporting the second support 282, whereby the second tub 220 may be fixed in the second cabinet 210.

The first support 281 may be provided as a first bracket protruded from the second cabinet 210, the second support 282 may be provided as a second bracket protruded from the second tub 220, and the second connector 283 connects the first bracket with the second bracket, and may be provided vertically to the ground.

Therefore, the volume of the support module 280 that includes the second connector 283 may be minimized, whereby the washing area of the second tub 220 may be increased.

The second connector 283 may include a first connector 283*a* mounted to pass through the first support 281, a second connector 283*b* supported to pass through the second support 282, and a connecting bar 283*c* for connecting the first connector 283*a* with the second connector 283*b*.

The first connector 283*a* and the second connector 283*b* may be provided to have a diameter greater than that of the connecting bar 283*c*, and may be provided in shapes of disk, hemisphere, and sphere. Therefore, the connector 283 may stably be coupled to the first support 281 and the second support 282.

As described above, the second tub 220 may be provided with the tub door 230, and the second cabinet 210 may be provided with the second cabinet door 216. In such scenarios, the tub door 230 may open the second inlet 221 in a state that the second cabinet 210 is closed. It may be difficult for the user to check whether the tub door 230 has opened the second inlet 221 due to the second cabinet door 216.

Also, even though the tub door 230 closes the second inlet 221 and the second cabinet door 216 closes the second opening 211, if vibration occurs in the second tub 220 and the second drum 240 due to the operation of the second washing apparatus 200, the tub door 230 may open the second inlet 221.

If the tub door 230 opens the second inlet 221, it is likely that the water or laundry contained in the second tub 220 may overflow toward the outside, whereby the user needs to recognize whether the tub door 230 has opened the second inlet 221.

To this end, the second washing apparatus 200 may include a sensor module 500 for sensing whether the tub door 230 has opened the second inlet 221 in a state that the cabinet door 216 closes the second opening 211.

Also, in some implementations the second washing apparatus 200 is not operated when the tub door 230 opens the second inlet 221 regardless of whether the second cabinet door 216 has been closed.

That is, if the tub door 230 is in an open state so as to open the second inlet 221, then the laundry treating apparatus may perform one or more of stopping the water supply to the second tub 220, stopping the drainage from the second tub 220, stopping the rotation of the second drum 240 due to the operation of the second driving module 250, and/or stopping the steam supply and hot-air supply to the second tub 220.

As such, implementations may mitigate the user being exposed to hot-air and water and laundry or water that may overflow to the outside of the second tub 220 if the second washing apparatus 200 is operated in a state that the second tub door 230 is opened.

Therefore, the sensor module 500 may be provided to sense that the tub door 230 has opened the second inlet 221 regardless of the fact that the second cabinet door 215 has been closed.

In some implementations, the second washing apparatus 200 may operate in a driving mode based on both the tub door 230 and the second cabinet door 215 being closed, or alternatively may operate in the driving mode based on the tub door 230 being closed regardless of the second cabinet door 215 being closed The sensor module 500 may be provided in the tub door 230 or the second cabinet door 216, or may be provided in both the tub door 230 and the second cabinet door 216.

The sensor module 500 may be provided to sense that the second cabinet door 216 and the tub door 230 are close to each other.

Referring to FIG. 2, the sensor module 500 may include a magnetic force generator 510 provided in any one of the second cabinet door 216 and the tub door 230 to generate a magnetic force, and a Reed sensor 520 provided in the other one of the second cabinet door 216 and the tub door 230 to sense a magnetic force of the magnetic force generator 510 and generate a signal.

The magnetic force generator 510 may be provided as any material, which generates a magnetic field, such as permanent magnet, electromagnet, and ferrite magnet. Also, the Reed sensor 520 may sense whether the magnetic force generator 510 has approached or become far away from the Reed sensor 520, by sensing the magnetic field of the magnetic force generator 510.

The magnetic force generator 510 may be provided at the end of the tub door 230, and the Reed sensor 520 may be provided at a corresponding position of the second cabinet door 216 when the tub door 230 has opened the second inlet 221.

Therefore, the Reed sensor 520 may sense the magnetic field of the magnetic force generator 510 if the tub door 230 is close to the second cabinet door 216, or may intensively sense the magnetic force generated in the magnetic force generator 510.

If the sensor module 500 receives a signal obtained by sensing the magnetic force of the magnetic force generator 510 through the Reed sensor 520, the first controller 190 or the second controller 290 may determine whether the tub door has opened the inlet in a state that the second cabinet door has closed the second opening.

Although FIG. 2 illustrates that the second controller 290 analyzes the signal of the sensor module 500, in some implementations at least one processor in addition to the second controller 290 may be provided to intensively analyze only the signal of the sensor module 500. This will equally be applied to the following implementations.

If the sensor module 500 senses that the second cabinet door 216 and the tub door 230 are close to each other, the controller (the first controller 190 or the second controller 290) may determine that the tub door 230 has opened the second inlet 221.

However, in some implementations, the second controller 290 may recognize that the second cabinet door 216 has closed the second opening 211.

Therefore, to identify whether the second cabinet door 216 has closed the second opening 211, the second cabinet 210 may include a second sensor module 600 that determines whether the second cabinet door 216 has approached the top front.

The second sensor module 600 may include a magnet provided at the front end of the second cabinet door 216, and a Reed sensor provided in the second cabinet 210. That is, the second sensor module 600 may be provided equally to the sensor described in FIG. 2.

Also, the second sensor module 600 may include a switch provided at the front of the second cabinet 210.

Finally, the second sensor module 600 may be provided to include any component if it could recognize that the second cabinet door 216 has closed the second opening 211.

That is, the controller (at least one of the first controller, the second controller, and the separate controller) may determine that the tub door 230 has opened the second inlet 221 if the signal of the sensor module 500 is sensed in a state that the second sensor 600 senses that the second cabinet door 216 has closed the second opening 211.

Hereinafter, another implementation of the sensor module 500 will be described in detail with reference to FIGS. 3A and 3B.

Figure 3A:
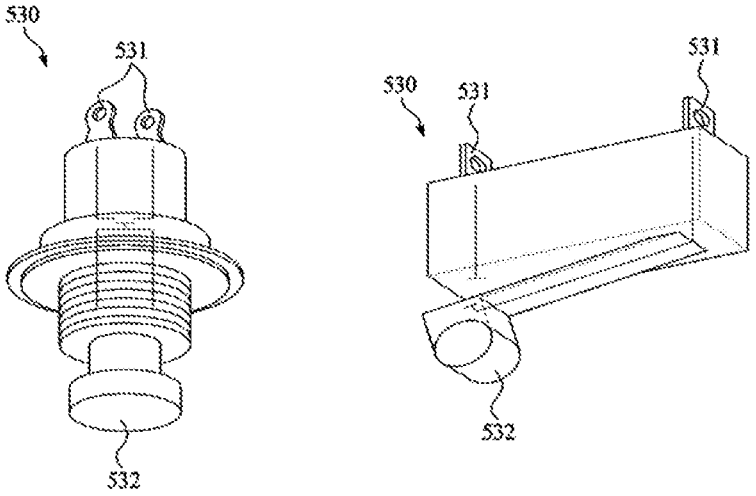
FIGS. 3A and 3B are diagrams that illustrate examples of components of a sensing unit that may sense that a door provided in a tub is opened.
Figure 3B:
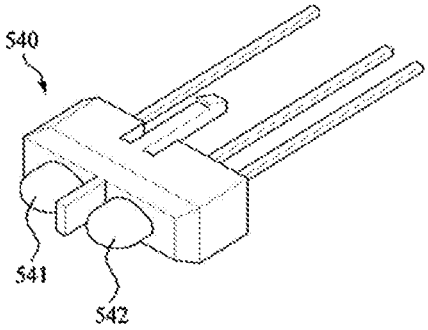

FIG. 3A illustrates that the sensor module 500 is provided as a switch, and FIG. 3B illustrates that the sensor module 500 is provided as an optical sensor.

The sensor module 500 may include a switch 530 provided in any one of the second cabinet door 216 and the tub door 230 to generate a signal if an external force is applied thereto.

When the tub door 230 is in contact with the second cabinet door 216 by opening the second inlet 221, the switch 530 should be operated. Therefore, in some implementations the switch 530 is provided in the tub door 230. In some implementations, the switch 530 may be provided at the front end of the tub door 230.

The switch 530 may include an electrode module 531 flowing electricity, and a moving module 532 connecting or disconnecting the electrode module 531.

It does not matter that the switch 530 may be provided in any shape if the moving module 532 can connect or disconnect electricity of the electrode module 531.

Also, the sensor module 500 may include an optical sensor 540 provided in any one of the second cabinet door 216 and the tub door 230 to sense illuminance and generate a signal.

Since the optical sensor 540 senses illuminance of a surrounding environment, the optical sensor 540 may be provided in the second cabinet door 216 only, or may be provided in the tub door 230 only.

The optical sensor 540 may recognize an image if the tub door 230 is close to the second cabinet door 216, or may generate a signal by sensing variation of internal illuminance.

Also, the optical sensor 540 may include an illuminator 541 for illuminating light, and a light-receiving portion 542 for sensing that the light generated from the illuminator 541 is reflected in a specific material and returns to the illuminator 541.

That is, the optical sensor 540 may include an illuminator 541 for illuminating light to any one of the second cabinet door 216 and the tub door 230, and a light-receiving portion 542 for sensing reflected intensity of light illuminated to the other one of the second cabinet door 216 and the tub door 230.

For example, if the optical sensor 540 is provided in the second cabinet door 216, the illuminator 541 illuminates light to the tub door 230.

Light reflected by the tub door 230 may be partially sensed by the light-receiving portion 542.

If the tub door 230 opens the second inlet 221 and thus is close to the second cabinet door 216, intensity of light sensed by the light-receiving portion 542 becomes strong. As a result, the optical sensor 540 may determine whether the tub door 230 has approached the second cabinet door 216.

In some implementations, if the controller recognizes that the tub door 230 has opened the second inlet 221 in a state that the second cabinet door 216 has closed the second opening 211, it is required to take action to avoid safety-accident such as overflow of water or laundry contained in the second tub 220.

Figure 4:
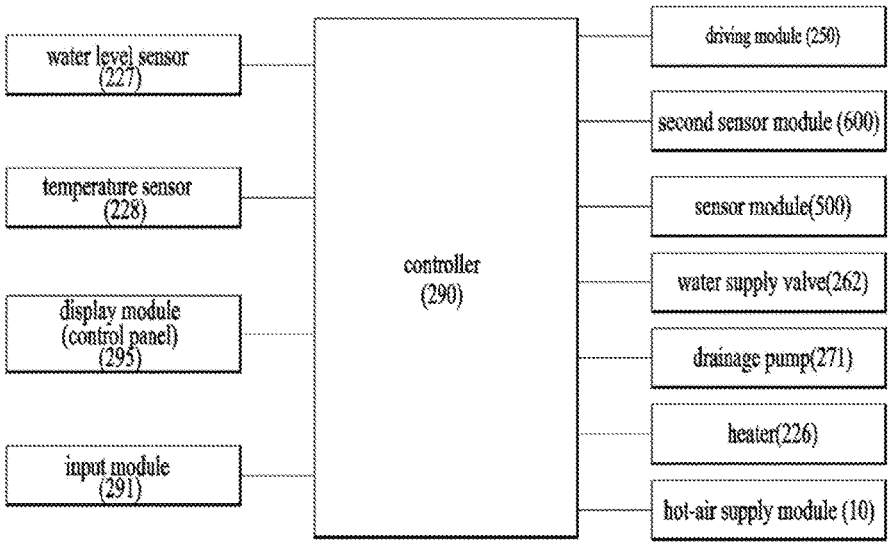
FIG. 4 is a diagram that illustrates an example of a function of a controller of a laundry treating apparatus according to some implementations.
Figure 5:
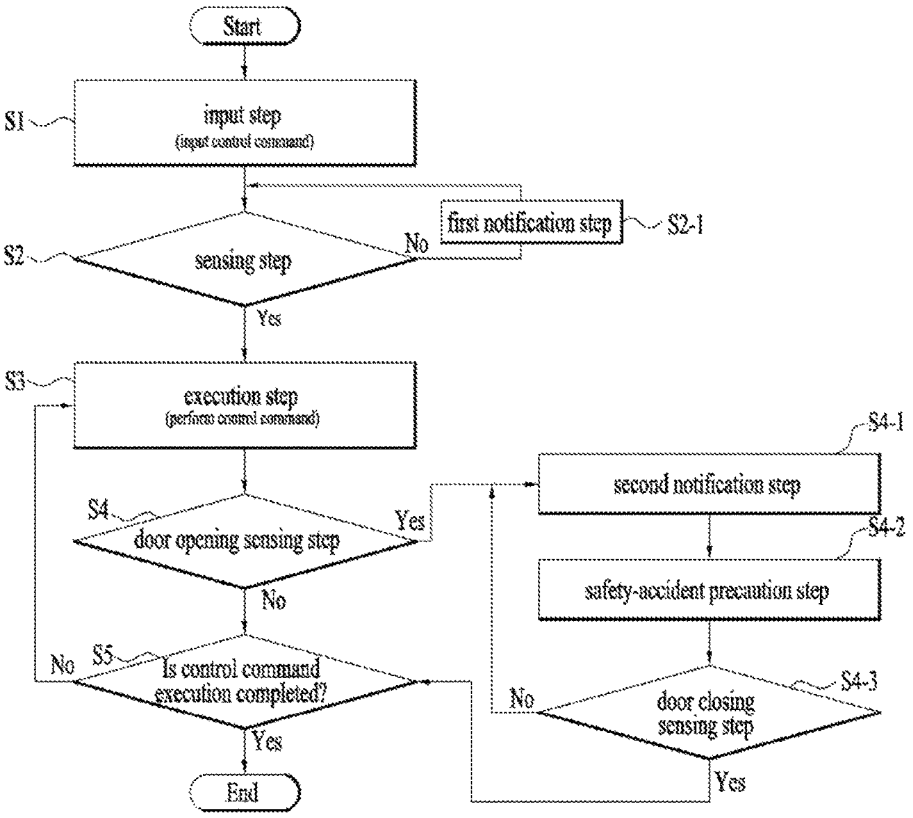
FIG. 5 is a flow chart illustrating an example of controlling a laundry treating apparatus according to some implementations.

Referring to FIG. 4, the controller 190 or 290 may be provided to control the second driving module 250, the water supply valve 262, the drainage pump 271, the heater 226, the hot-air supply module 10, the display module 295, etc. In some implementations, as described above, the controller 190 or 290 may be at least one of the first controller 190 and the second controller 290.

Hereinafter, the second controller 290 will be described. However, it is not excluded that the function of the second controller 290 is replaced with the first controller 190 or a separate controller is provided.

The second controller 290 may receive any one of washing, rinsing, drying, and dehydrating or a combined washing course of washing, rinsing, drying, and dehydrating from the second input module 291.

Also, the second controller 290 may supply steam or hot-air into the second tub 220 or heat the water supplied into the second tub 220 by controlling the heater 226 and the hot-air supply module 10.

Also, the second controller 290 may supply the water to the second tub 220 or drain the water from the second tub 220 by controlling the water supply valve 262 and the drainage pump 271.

In some implementations, the second washing apparatus 200 of the present disclosure may perform any one of a washing stroke for washing laundry, a rinsing stroke for rinsing laundry, a dehydrating stroke for removing water of laundry, and a drying stroke for removing water by drying laundry, and may perform a specific washing course according to combination of the above strokes.

If the laundry treating apparatus 200 performs the washing stroke, the rinsing stroke, the dehydrating stroke and the drying stroke, the second drum 240 may be rotated, the water may be supplied to or drained from the second tub 220, and steam or hot-air may be supplied to the second tub 220 or the second drum 240. In some implementations, rotation of the second drum 240, water supply or drainage of the second tub 220, or steam or hot-air supply to the second tub 220 may be defined that the laundry treating apparatus is operated. When the laundry treating apparatus is operated, various safety-accidents may occur if the tub door 230 opens the second inlet 221.

Also, if the tub door 230 is opened at the second inlet 221 in a state that a temperature inside the second tub 220 is a reference temperature or more, the user may be exposed to heat, whereby the user may be burned. The reference temperature may be defined as a temperature that allows the user to be burned or physically or psychologically damaged by heat. For example, the reference temperature may be 45° C.

Also, in a state that steam or hot-air is supplied into the second tub 220, if the tub door 230 is opened at the second inlet 221, the same result as the state of the reference temperature or more may occur.

Therefore, if the laundry treating apparatus 200 is being operated or a control command to start the operation of the laundry treating apparatus 200 is input, the tub door 220 needs to the state that second inlet 221 is closed.

In some implementations, at least one processor (e.g., a controller) for controlling a driving mode of the first washing apparatus and at least one processor (e.g., a controller) for controlling a driving mode of the second washing apparatus may be provided independently from each other. That is, each of the washing apparatuses may be controlled to be driven independently.

However, if a problem occurs in any one of the washing apparatuses, it is required to stop the driving mode of the other washing apparatus. Therefore, in some implementations, the controller of the second washing apparatus may control the driving mode of the first washing apparatus to be stopped through the controller of the first washing apparatus. For example, if it is determined through the sensor module that the tub door of the second washing apparatus is opened, the driving mode of the first washing apparatus may be stopped.

Hereinafter, a control method for safety accident prevention of the laundry treating apparatus 200 will be described with reference to FIG. 6.

In the control method of the laundry treating apparatus 200 according to the present disclosure, the second controller 290 may perform an input step S1 of receiving a control command for operating the laundry treating apparatus 200 from a control panel or the input module 291.

Also, the input step S1 may be defined as a step of allowing the second controller 290 to send a control command corresponding to a signal input from the input module 291 to each component of the laundry treating apparatus 200.

That is, the control command for allowing the second controller 290 to operate the laundry treating apparatus 200 may be a response to the input of the user to the input module 291 with respect to the specific course for performing washing, rinsing, dehydrating and drying.

In other words, if the user inputs the course for performing washing, rinsing, dehydrating and drying through the input module 291, the second controller 290 may be scheduled to perform an algorithm such as water supply or drainage with respect to the second tub 220 of the laundry treating apparatus 200, rotation of the second drum 240 and supply of steam or hot-air to the second tub.

In some implementations, the second controller 290 may perform a sensing step S2 of sensing whether the tub door 230 has completely closed the second inlet 221 by controlling at least one of the sensor module 500 or the second sensor module 600.

If it is not sensed at the sensing step S2 that the tub door 230 has completely closed the second inlet 221, the second controller 290 may be on standby for a certain time until the tub door 230 completely closes the second inlet 221.

A first notification step S2-1 of displaying a sound or alarm indicating that the tub door 230 has been opened at the second inlet 221 on the second display module 295 to guide the user to allow the tub door 230 to completely close the second inlet 221 may be performed.

As a result, the operation of the laundry treating apparatus 200 may be prevented from starting when the tub door 230 is not inserted into the second inlet 221 completely.

Therefore, the sensing step S2 may be the most fundamental step of preventing safety-accident in operation of the laundry treating apparatus 200.

Also, the sensing step S2 may sense whether the tub door 230 has opened the second inlet 221 in a state that the second cabinet door 216 has closed the second opening 211.

If it is sensed at the sensing step S2 that the tub door 230 has completely closed the second inlet 221 through the sensor module 500 or the second sensor module 600, the second controller 290 may control the laundry treating apparatus 200 to perform an execution step S3 of performing the input control command.

As described above, the control command may correspond to any one of washing, rinsing, dehydrating and drying strokes input by the user, or may correspond to at least one of water supply or drainage of the second tub, rotation of the second drum 240, and steam or hot-air supply to the second tub 220 to perform a combined course of the above strokes.

In some implementations, even though the tub door 230 has closed the second inlet 221, the tub door 230 may be opened in the course of the execution step S3 due to various causes such as vibration of the drum 5.

If the tub door 230 is opened, water, laundry, and detergent contained in the second tub 220 or the second drum 240 may overflow toward the outside of the second tub 220 even though the second cabinet door 216 is closed.

The overflown water, laundry and detergent may contaminate the inside of the second tub 220 or the second cabinet 210, and may also corrode the inside of the second washing apparatus 200 or cause safety-accident such as short circuit.

Therefore, if the tub door 230 is opened during the execution step S3, it is required to guide the user to open the second cabinet door 216 and again close the tub door 230.

Therefore, if the tub door 230 is opened during the execution step S3, it is required to stop the operation of the laundry treating apparatus 200. Moreover, it is required to guide the user to safely close the tub door 230 second cabinet door 216 and again close the tub door 230.

To this end, the second controller 290 may perform a door opening sensing step S4 of sensing whether the tub door 230 has opened the second inlet 221 through the sensor module 500 before the step execution S3 is completed.

If it is sensed by the sensor module 500 that the tub door 230 is opened, the second controller 290 may perform a second notification step S4-1 of displaying that the tub door 230 is opened on the second display module 295 to notify the user of it.

Afterwards, the second controller 290 may perform a safety-accident precaution step S4-2 of allowing a user to completely close the tub door 230 by opening the second cabinet door 216.

The safety-accident precaution step S4-2 is to satisfy a safety condition of the second washing apparatus 200, wherein the safety condition may correspond to at least one of the state that rotation of the second drum 240 is stopped, the state that water supply or drainage of the second tub 220 is completed, the state that steam or hot-air supply to the second tub 220 is stopped, and the state that a temperature inside the second tub 220 is a reference temperature or less.

However, in some implementations, the laundry treating apparatus may be configured to satisfy the aforementioned safety condition in all the scenarios of the state that rotation of the second drum 240 is stopped, the state that water supply or drainage of the second tub 220 is completed, the state that steam or hot-air supply to the second tub 220 is stopped, and the state that a temperature inside the second tub 220 is a reference temperature or less.

Therefore, the safety-accident precaution step S4-2 may include at least one of stop of rotation of the second drum 240, at least any one of approach prohibition of the user to the second tub 220 until the temperature of the second tub 220 reaches a reference temperature or less by means of notification through the display module 295, actuation of a fan and supply of cooling water, and stop of hot-air and steam supply to the second tub 220.

In some implementations, the second controller 290 may perform a door closing sensing step S4-3 of sensing whether the tub door 230 has closed the second inlet 221 by controlling the sensor module 500.

If it is sensed in the door closing sensing step S4-3 that the tub door 230 has closed the second inlet 221, the second controller 290 may perform a previously input control command by returning to the state that the tub door 230 is not opened.

However, if it is sensed in the door closing sensing step S4-3 by the sensor module 500 or the second sensor module 600 that the tub door 230 has opened the second inlet 221, the second controller 290 may return to the second notification step S4-1 and then repeat the aforementioned steps.

The second controller 290 may perform a step S5 of determining whether the control command has been completely performed.

Afterwards, if the control command is not performed completely, the second controller 290 may perform the control command by returning to the step execution S3 and then repeat the aforementioned steps until the control command is completely performed.

Implementations of the present disclosure may be implemented in other specific forms without departing from the spirit and essential characteristics of the invention. Thus, the above implementations are to be considered in all respects as illustrative and not restrictive. The scope of the invention should be determined by reasonable interpretation of the appended claims and all change which comes within the equivalent scope of the invention are included in the scope of the invention.

What is claimed is:

1. A laundry treating apparatus comprising:

a cabinet provided with an opening;

a cabinet door provided in the cabinet and configured to open or close the opening;

a tub configured to hold water and having an opening at a top of the tub that is accessible through the opening of the cabinet;

a tub cover arranged on the tub and provided to cover the top of the tub, the tub cover defining an inlet through which an inside of the tub is accessible;

a tub door provided at the tub cover and configured to open or close the inlet of the tub cover separately from the cabinet door opening or closing the opening;

a drum provided inside the tub and configured to rotate about a vertical rotational shaft inside the tub; and a first sensor module configured to generate a signal based at least in part on sensing an open state of the tub door.

2. The laundry treating apparatus according to claim 1, further comprising at least one processor configured to control the laundry treating apparatus by operating the laundry treating apparatus in a driving mode based at least in part on the first sensor module sensing that the tub door of the tub is in a closed state.

3. The laundry treating apparatus according to claim 2, further comprising a notification unit configured to output a notification that the laundry treating apparatus cannot be operated in the driving mode based at least in part on the first sensor module sensing that the tub door of the tub is in the open state.

4. The laundry treating apparatus according to claim 1, further comprising at least one processor configured to control the laundry treating apparatus by:

in a state of the laundry treating apparatus being operated in a driving mode, stopping the driving mode of the laundry treating apparatus based at least in part on the first sensor module sensing that the tub door of the tub is in the open state.

5. The laundry treating apparatus according to claim 4, wherein the at least one processor is configured to, in a state in which the laundry treating apparatus has been stopped from operating in the driving mode, start the driving mode of the laundry treating apparatus based at least in part on the first sensor module sensing that the tub door of the tub is in a closed state.

6. The laundry treating apparatus according to claim 1, further comprising:

a second sensor module configured to sense whether the cabinet door is in an open state or in a closed state, wherein the laundry treating apparatus is configured to enable the first sensor module based at least in part on the second sensor module sensing that the cabinet door is in the closed state.

7. The laundry treating apparatus according to claim 6, further comprising at least one processor configured to control the laundry treating apparatus by:

based at least in part on a determination, through the second sensor module, that the cabinet door is in the open state during operation of a driving mode of the laundry treating apparatus, stopping the driving mode of the laundry treating apparatus and disabling a sensing operation of the second sensor module.

8. The laundry treating apparatus according to claim 1, wherein:

in a state in which the cabinet door and the tub door are closed, the cabinet door is arranged to be spaced apart from a top surface of the tub door.

9. The laundry treating apparatus according to claim 8, wherein the tub door comprises a first hinge and the cabinet door comprises a second hinge.

10. The laundry treating apparatus according to claim 9, wherein the tub door and the cabinet door are configured to be opened and closed by rotation about the first hinge and the second hinge, respectively, and wherein:

the first hinge that rotates the tub door comprises a first shaft, the second hinge that rotates the cabinet door comprises a second shaft, and the first shaft and the second shaft are arranged in parallel with each other.

11. The laundry treating apparatus according to claim 1, wherein the first sensor module is configured to sense a change in distance between the cabinet door and the tub door.

12. The laundry treating apparatus according to claim 11, wherein the first sensor module comprises:

a magnetic force generator provided in one of the cabinet door or the tub door, and a magnetic force sensor provided in the other one of the cabinet door or the tub door, the magnetic force sensor configured to sense a change of a magnetic force of the magnetic force generator.

13. The laundry treating apparatus according to claim 11, wherein the first sensor module comprises a push switch provided in one of the cabinet door or the tub door.

14. The laundry treating apparatus according to claim 1, wherein the first sensor module comprises:

an illuminator provided in one of the cabinet door or the tub door and configured to illuminate light, and a light-receiving module provided in one of the cabinet door or the tub door and configured to sense the illuminated light.

15. The laundry treating apparatus according to claim 1, the tub door comprises a sealing module configured to, when the tub door is in a closed state and closes the inlet of the tub cover, seal the inside of the tub from an outside of the tub.

16. The laundry treating apparatus according to claim 1, wherein the first sensor module is configured to generate the signal based at least in part on sensing the open state of the tub door by:

generating the signal based on sensing the open state of the tub door, and further based on the cabinet door being in a closed state.

17. The laundry treating apparatus according to claim 16, further comprising a second sensor module configured to sense whether the cabinet door is in an open state or in the closed state.

18. The laundry treating apparatus according to claim 2, wherein the at least one processor is configured to operate the laundry treating apparatus in the driving mode based at least in part on the first sensor module sensing that the tub door is in the closed state by:

operating the laundry treating apparatus in the driving mode based on the first sensor module sensing that the tub door is in the closed state, and further based on the cabinet door being in a closed state.

* * * * *